United States Patent [19]

Eguchi

[11] 4,196,683

[45] Apr. 8, 1980

[54] SEWING MACHINE WITH A STITCH PATTERN SELECTING DEVICE

[75] Inventor: Yasukata Eguchi, Kunitachi, Japan

[73] Assignee: Janome Sewing Machine Co. Ltd., Tokyo, Japan

[21] Appl. No.: 822,692

[22] Filed: Aug. 8, 1977

[30] Foreign Application Priority Data

Aug. 6, 1976 [JP] Japan ..... 51/93144
Sep. 11, 1976 [JP] Japan ..... 51/109312

[51] Int. Cl.[2] ..... D05B 3/02
[52] U.S. Cl. ..... 112/158 E
[58] Field of Search ..... 112/158 E, 158 A, 158 B, 112/158 R

[56] References Cited

U.S. PATENT DOCUMENTS

| | | | |
|---|---|---|---|
| 4,016,821 | 4/1977 | Minalga | 112/158 E |
| 4,066,029 | 1/1978 | Suchsland et al. | 112/158 E |
| 4,084,523 | 4/1978 | Kasuga | 112/158 A |

*Primary Examiner*—Peter Nerbun
*Attorney, Agent, or Firm*—Michael J. Striker

[57] ABSTRACT

In a sewing machine with a stitch pattern selecting device according to the invention, the selection of stitch patterns being carried out by axial movement of a cam follower along a pack of pattern cams, such movement resulting from control by a reversible electric motor, and memory means for generating follower control signals corresponding to input pattern selection signals.

12 Ciaims, 13 Drawing Figures

SEWING MACHINE WITH A STITCH PATTERN SELECTING DEVICE

BRIEF DESCRIPTION OF THE INVENTION

This invention relates to a stitch pattern selecting device for a sewing machine, and more particularly to a device which is compact in structure and positively operates to select the stitch patterns.

In this kind of conventional device, mechanical or electrical, the machine operator has to operate, for example, one operating member to displace an indicator or the light of an indicating lamp to a desired pattern indicating position, and therefore if there are a substantial number of patterns to be selected, this increases the amount as well as the time of pattern selecting work. In the push button type of conventional pattern selecting device which directly selects a desired pattern, the number of cam followers and other associated elements consequently increases for the limited space within the machine frame. Such a device also goes against the inclination of manufacturers to reduce the weight of the sewing machine.

The device of the present invention has been provided to overcome the defects and shortcomings of the prior art. It is a basic object of the invention to combine a reversible motor and a position sensor for automatically operating the whole process of a pattern selection by means of a slight touch onto the concerned parts by the operator.

It is a second object of the invention to provide automatic or manual adjustment of the amount of the bight of the needle and of the cloth feed needed for stitch patterns.

It is third object of the invention to be able to obtain buttonhole stitches with a variable amount of the bight of the needle and/or the feed by means of a suitable combination of electric control mechanisms.

Many other features and advantages of the invention will be apparent from the following description of the preferred embodiments with reference to the attached drawings.

DETAILED DESCRIPTION OF THE INVENTION

Figure 1:
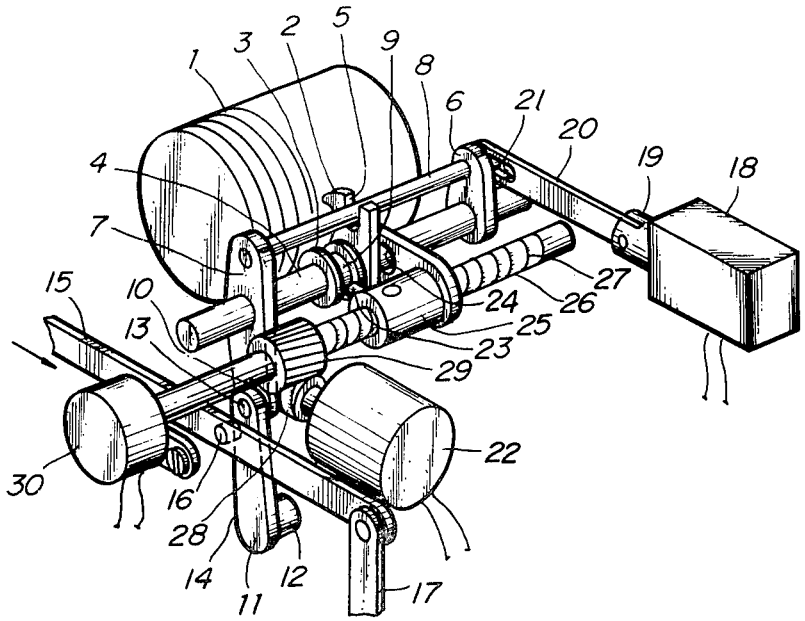
FIG. 1 is a perspective view of the pattern selecting device of a first embodiment of the invention.
Figure 2:
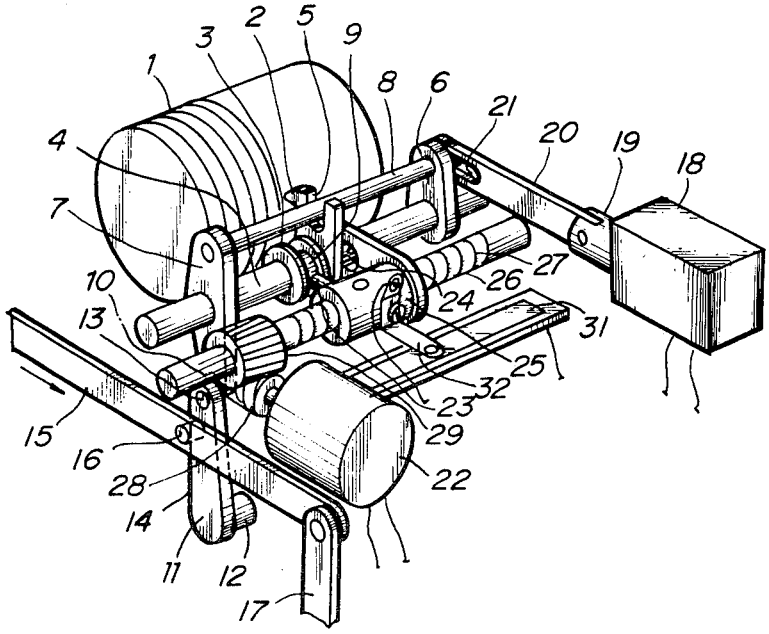
FIGS. 2–5 show each different embodiments of pattern selecting devices of the invention.
Figure 3:
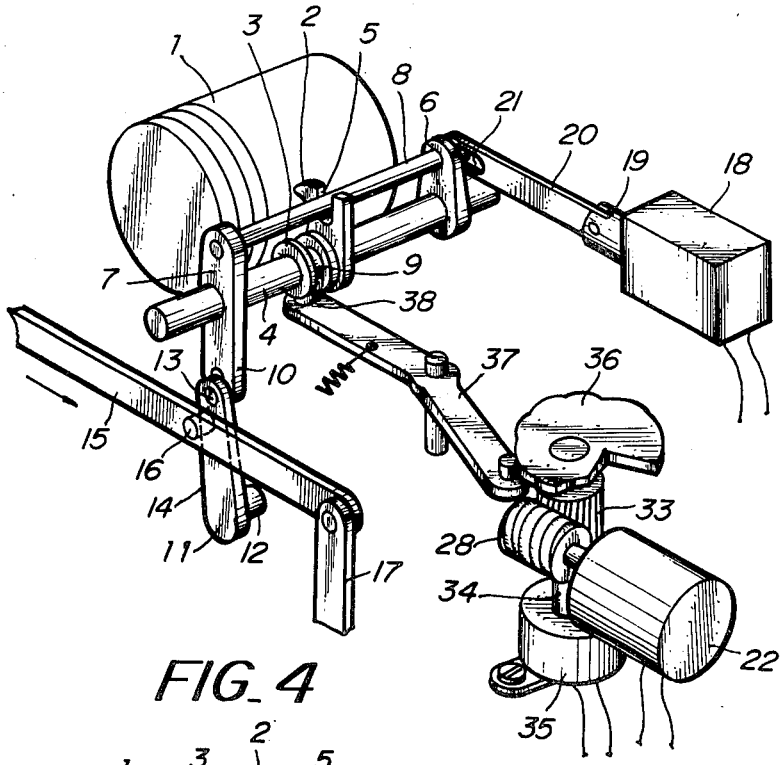
Figure 4:
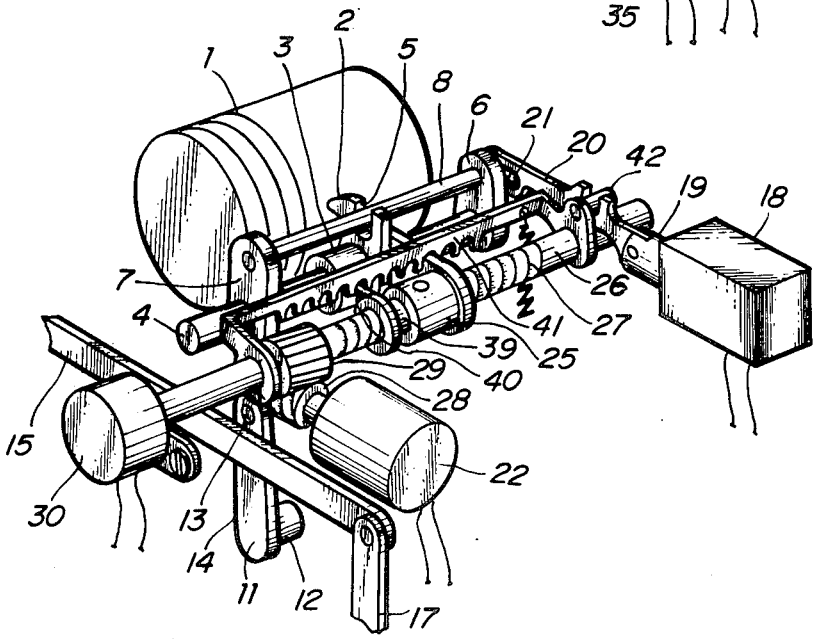

The invention will be discussed with reference to the accompanying drawings. In FIG. 1 to FIG. 5 within the machine frame of the sewing machine (not shown) there is arranged a dynamic mechanical memory (1) storing a plurality of stitch patterns, namely a pack of cams to be rotated in synchronism with rotation of the main shaft (not shown) of the sewing machine. In this regard, such a mechanical memory can be easily replaced by a magnetic memory. A read-out member (2), for example, a cam follower for extracting the information stored in the memory (1) is arranged opposite to the memory (1) and is displaceable along the memory. That is, the cam follower (2) with a boss (3) is formed with a groove (9) in the circumference thereof. A notch (5) formed in the cam follower is engaged by a transverse shaft (8) supported by a pair of arms (6)(7) which are swingable around the shaft (4). The arm (7) has a lower end provided with a fork (10) which is engaged by a pin (13) of a swing arm (11). A pin (16) positioned on a transmission rod (15) is pressed to one side (14) of the swing arm (11) by means of a spring (not shown). The transmission rod (15) is at the one end connected to a link (17) which is adjustably turned by operation of a bight adjuster (not shown) provided outside of the machine frame, and is at the other end connected to a swingable frame supporting the needle bar (not shown). One end of the shaft (8) between the arm members (6)(7) is in engagement with an oblong hole (21) of a bar (19) of an electric driver (18) which may be a magnetic solenoid. Therefore, the shaft (8) can be swung around the shaft (4) by the electric driver (18) and the read-out member (2) can be engaged to and disengaged from the cams (1). The read-out member (2) is connected to a reversible motor (22), for example, a servomotor, which displaces the member (2) along the pack of cams (1). A moving member (25) is mounted on a transverse thread shaft (26) and has a pin (23) engaging the groove (9) of the cam follower (2). The member (25) has a fork portion (24) engaging the shaft (4) for preventing the member (25) from swinging on the shaft (26). Since a spiral groove (27) formed around the outer circumference of the shaft (26) is engaged by an inner projection (not shown) of the moving member (25), this member (25) is axially moved upon rotation of the shaft (26). The drive shaft (26) has a worm wheel (29) secured thereto, which is in engagement with a worm (28) secured on the rotatable shaft of the reversible motor (22). A position sensor (30) for the read-out member (2) is mechanically connected to the reversible motor (22). The embodiments in FIG. 1 and FIG. 4 comprise, for example, a rotary potentiometer fixed to a bracket (not shown) and its rotary portion (30) is fixed to the drive shaft (26). FIG. 2 shows that a sheet resistor (31) is arranged in parallel to the drive shaft (26) and is engaged by a contact (32) projecting from the moving member (25). FIG. 3 shows a worm wheel (33) on a vertical shaft (34) in engagement with the worm (28) of the reversible motor (22). The rotary portion of a rotary potentiometer (35) is fixed to the lower end of the shaft (34) and a cam (36) is secured to the upper end of the shaft (34). A lever (37) pivoted at its center is at one end thereof in engagement with the cam (36) and has a pin (38) fixed to the other end thereof engaging the groove (9) of the boss of the cam follower (2). In the embodiment shown in FIG. 4, in order to exactly position the cam follower (2) and the moving member (25), this member (25) is formed with a groove (39), into which a pin (40) fixed to the cam follower (2) is placed. A toothed bar (41), which is to engage the pin (40), is turnable on the shaft (26) by the action of the magnetic solenoid (18) which has the bar (20) in engagement with a pin (42) of the toothed bar (41) as shown.

Figure 5:
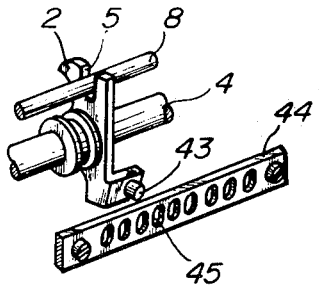

Another embodiment shown in FIG. 5 comprises a device for exactly positioning the cam follower (2). A pin (43) is as shown provided on the cam follower (2) so that it may be engaged by any one of holes (45) of a positioning plate (44) at each selected position of the cam follower (2). Such an embodiment may be regarded as equivalent to the above mentioned one.

Figure 6:
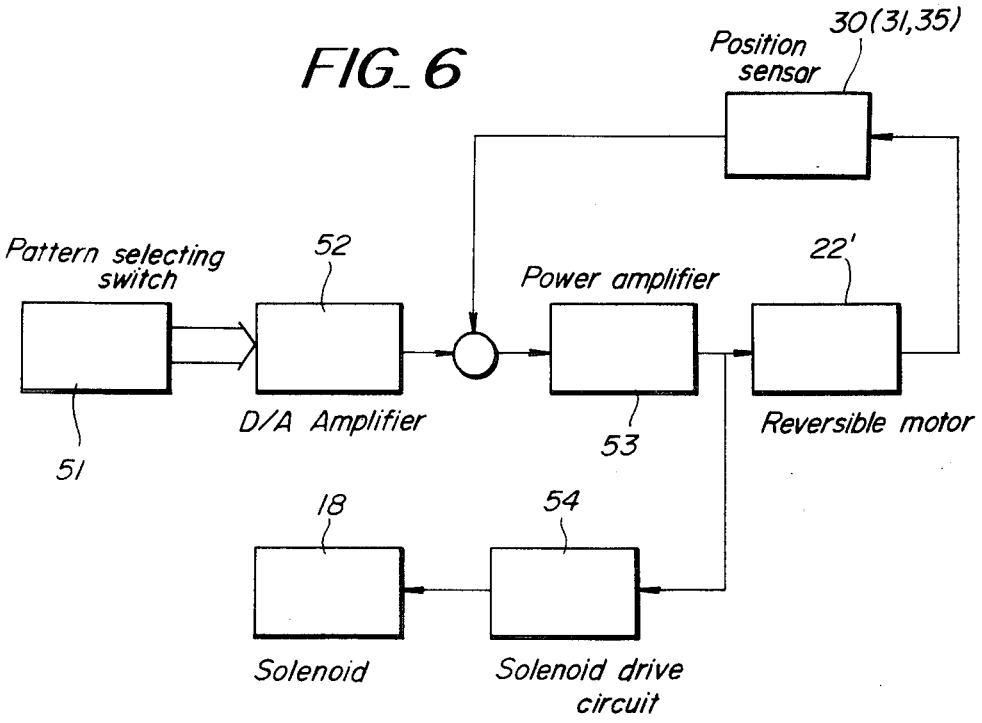
FIG. 6 is an electric block diagram of the invention.

As shown in FIG. 6, a selector (51) for selecting stitch patterns is provided on the outside of the machine frame of the sewing machine. A different signal is issued for each of the selectable stitch patterns by operation of the selector (51). An output signal from the selector (51) is converted in a digital-analog converter (52). The D/A converter (52) and potentiometer (30) or (31) or (35) are connected to a power amplifier (53) so as to compare the converted analog output signal with a position-indicating signal from the potentiometer. Namely they are connected to compare the command voltage from the pattern selector (51) with a feedback voltage from the potentiometer, i.e. a variable resistor (30) or (31) or (35) which is driven by reversible motor (22), so that the motor (22) may be driven until the potential difference becomes 0. The power amplifier (53) is connected to a solenoid driving circuit (54) for actuating the solenoid (18) to release the cam follower (2) from the pack of cams (1).

Figure 7:
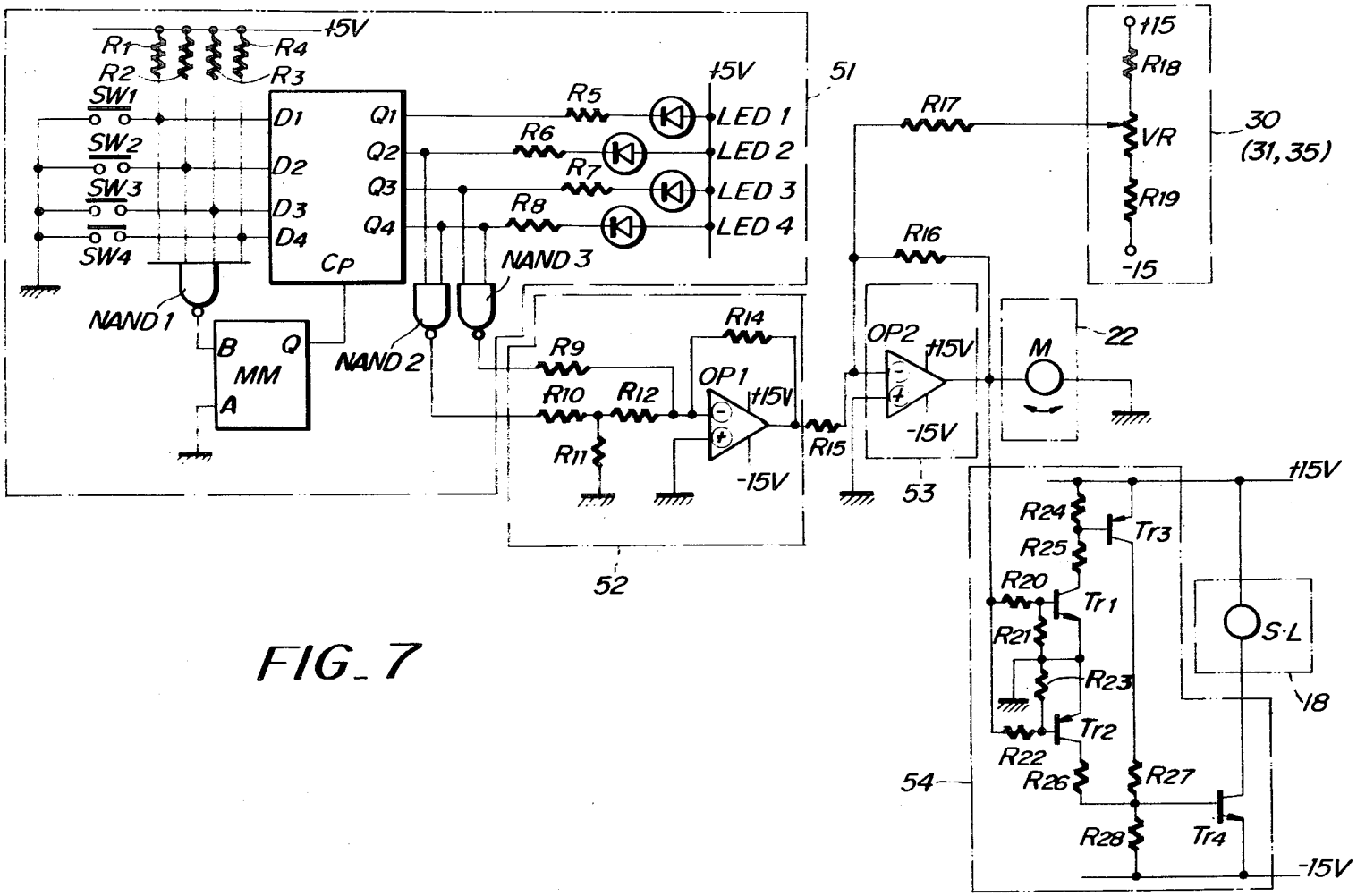
FIG. 7 is an electric circuit of the invention.

Reference will now be made to the electric circuit shown in FIG. 7. Pattern selecting switches SW1-SW4 are grounded at their left ends and are connected to input terminals D1-D4 of a latch circuit at their right ends. Resistors R1-R4 are biasing resistors. When one of the switches SW1-SW4 is selected, one input of NAND circuit NAND1 goes to low level (0 V) and its output goes to high level (5 V). The output of NAND1 is connected to the trigger terminal B of a monostable multivibrator circuit MM, and when the output of NAND1 changes from the low level to the high level, the monostable multivibrator is triggered and the output Q goes to high level for a certain period of time. Since the output Q of the monostable multivibrator circuit MM is connected to the latch terminal Cp of the latch circuit, the signals of the input terminals D1-D4 are latched when the input terminal Cp is at high level, and are transmitted to the outputs Q1-Q4. NAND2 and NAND3 are provided for encoding the outputs Q1-Q4 of the latch circuit.

The relation between the pattern selecting switches and the associated elements is as follows;

| Pattern selecting switches | | | | Latch circuits | | | |
|---|---|---|---|---|---|---|---|
| SW1 | SW2 | SW3 | SW4 | Q1 | Q2 | Q3 | Q4 |
| 0 | x | x | x | L | H | H | H |
| x | 0 | x | x | H | L | H | H |
| x | x | 0 | x | H | H | L | H |
| x | x | x | 0 | H | H | H | L |

| Codes | | Luminous diodes | | | |
|---|---|---|---|---|---|
| NAND2 | NAND3 | LED1 | LED2 | LED3 | LED4 |
| L | L | 0 | X | X | X |
| H | L | X | 0 | X | X |
| L | H | X | X | 0 | X |
| H | H | X | X | X | 0 |

L: Low level
H: High level

The outputs Q1-Q4 of the latch circuit are connected to the luminous diodes LED1-LED4 via voltage limiting resistors R5-R8. The outputs of NAND2 and NAND3 are converted from digital to analog in an operational amplifier OP1 having a ladder network composed of resistors R9-R12. The analog output voltage from converter 52 is compared with the feedback voltage furnished by the variable resistor VR of feedback potentiometer 30, and to this end is transmitted via a resistor R15 to the inverting input of an operational-amplifier power amplifier OP2. R14 and R16 designate ordinary operational-amplifier feedback resistors, and R17 is a resistor transmitting the feedback voltage from VR likewise to the inverting input of operational amplifier OP2. The command voltage from converter 52 is, as already stated, in analog form and, due to the user of the encoding NAND-gates NAND2, NAND3 and the ladder network R9-R12, has a value indicating what the desired position of cam follower 2 is to be. In accordance with usual servo principles, the non-zero output voltage at the output of OP2 causes motor (22) to turn, and thereby shift follower (2) and correspondingly change the setting of potentiometer (30), (31) or (35) until the difference between the commanded and actual positions of follower (2) goes to zero. A circuit (54) for operating the follower releasing solenoid S.L (18) actuates transistors Tr1 and Tr2 via resistors R20 and R22 connected to the power amplifier OP2(53). When the power amplifier OP2(53) issues a positive voltage, the transistor Tr1 is biased in the forward direction and becomes conductive while the transistor Tr2 is biased in the reverse direction to be non-conductive.

Since the transistor Tr3 is connected via the resistor R25 to the transistor Tr1, the transistor Tr3 becomes conductive when the transistor Tr1 is conductive (and vice versa). Therefore, the transistor Tr4 becomes conductive via the resistor R27 to subsequently energize the follower releasing solenoid S.L (18). If the output of the power amplifier OP2(53) is a negative voltage, the transistor Tr1 is biased in the reverse direction and the transistor Tr2 is biased in the forward direction to be conductive. Therefore the transistor Tr4 becomes conductive via the resistor R26 for energizing the follower releasing solenoid S.L (18). Namely, the positive or negative voltage from the power amplifier OP2(53) energizes the solenoid (18). The transistors Tr1 and Tr2 are both non-conductive when the voltage divided by the resistors R20, R21 or R22, R23 is lower than the base-emitter voltage $V_{BE}$ of the transistor Tr1 or Tr2.

Thus, in the embodiments of the invention, when a stitch pattern is selected by operating one of the pattern selecting switches of selector (51), a signal is issued, and the solenoid (18) is energized to disengage the read-out member (2) from the mechanical memory (1), and then the reversible motor (22) is driven. This reversible motor displaces the moving member (25) on the shaft (26) relative to the mechanical memory (1) through the worm (28) and the worm wheel (29). The displacement of the cam follower (2) continues until the potential difference becomes 0 between the command voltage from the D/A converter 52 and the voltage fed back from the position sensor (30). Thus, the follower member (2) is exactly stopped at the desired position relative to the mechanical memory or the pack of pattern cams (1).

Figure 8:
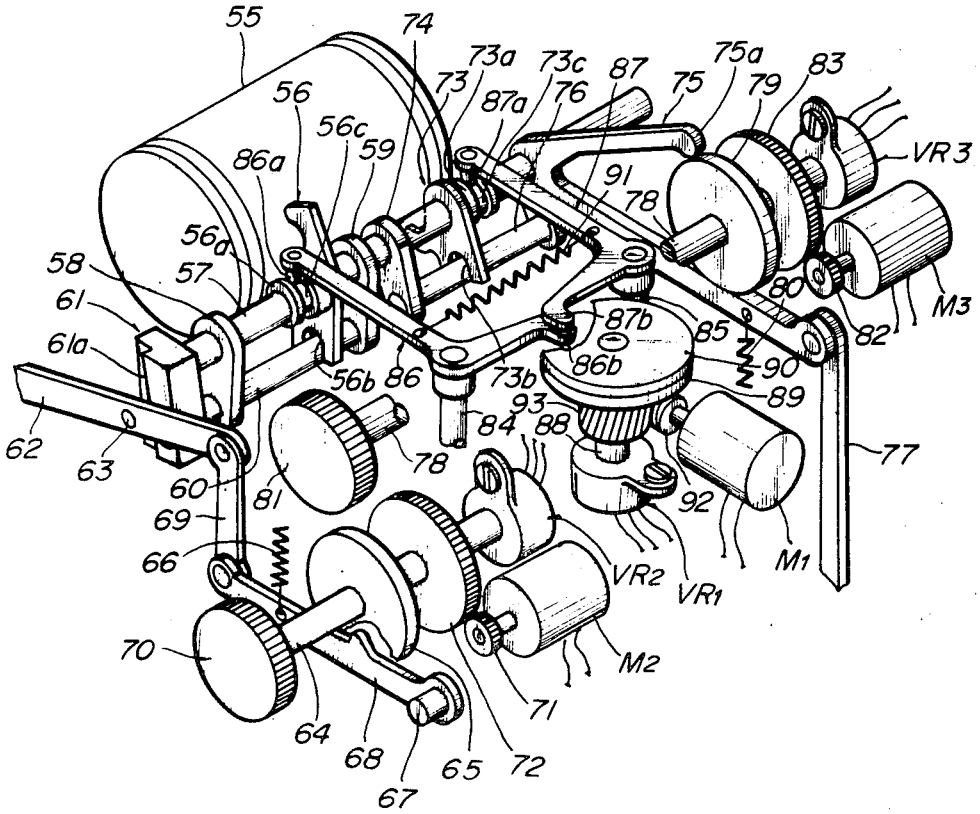
FIG. 8 is another embodiment of a pattern selecting device of the invention.

Reference will now be made to another embodiment shown in FIG. 8. Within the machine frame of the sewing machine (not shown) there is arranged a mechanical memory (55) which stores a plurality of stitch patterns, namely a pack of disc-like cams to be rotated in synchronism with rotation of the main shaft of the sewing machine (not shown). A first read-out member (56), namely, a cam follower, for extracting information from the memory (55), is arranged opposite to the memory (55). The cam follower (56) with a boss (56*a*) is slidably mounted on a shaft (57) and is slidable in parallel to and relative to the pack of pattern cams (55). The boss (56*a*) is formed with a groove (56*c*) in the circumference thereof. A fork (56*b*) formed in the lower end of the cam follower (56) engages a transverse shaft (60) supported between a pair of arms (58)(59) which are swingable around the shaft (57). A swing arm (61) is swingably mounted at one end of the shaft (57) and is at the lower end thereof connected to one end of the shaft (60). Therefore the swing arm (61) is swung around the shaft (57) when the cam follower (56) is swung around the shaft (57). A pin (63) positioned on a transmission rod (62) is pressed against an inclined face (61*a*) of the swing arm (61) by means of a spring (not shown). The transmission rod (62) is at one end connected to a swing frame (not shown) supporting the needle bar and is at the other end connected to a link (69) which is in turn connected to an adjusting arm (68) which is turnably mounted on the machine frame by means of a pivot (67) and is urged by a spring (66) to a bight adjusting cam (65) fixed to a bight control shaft (64) which is rotatably supported on the machine frame. A manually operated dial (70) is mounted on one end of the shaft (64) which projects out of the machine frame. The bight adjusting cam (65) is connected to a reversible motor (M2), for example, servomotor, via a gear wheel (72) secured to the control shaft (64) and a pinion (71) fixed to the rotary shaft of the reversible motor (M2). A position detector (VR2) is also mounted on the control shaft (64) for sensing the position of the reversible motor (M2).

The second read-out member (73), the feed control cam follower, is arranged opposite to the memory (55). The feed control cam follower (73) with a boss (73*a*) is slidably mounted on the shaft (57) and is slidable in parallel to and relative to the pack of cams (55). The boss (73*a*) is formed with a groove (73*c*) in the circumference thereof. A fork (73*b*) formed in the cam follower (73) engages a transverse shaft (76) supported by the arm (74) and by the feed control arm (75) which are swingably mounted on the shaft (57). The feed control arm (75) is at its one end connected to a feed adjusting rod (77) which is connected to a feed adjusting device (not shown) for adjusting the feeding amount and the feeding direction. A pawl (75*a*) at the other end of the feed control arm (75) is, by the action of the spring (80), in engagement with a feed controlling cam (79) secured to a feed controlling shaft (78) which is rotatably supported on the machine frame. A manually operated dial (81) is fixed to one end of the shaft (78) which projects out of the machine frame.

The feed adjusting cam (79) is connected to a reversible motor (m3) via a gear wheel (83) which is secured to the control shaft (78) and engages the pinion (82) fixed to a rotary shaft of the reversible motor (M3). A position detector (VR3) is mounted on the shaft (78) for sensing the position of the reversible motor (M3). The grooves (56*c*)(73*a*) of bosses (56*a*)(73*c*) of the cam followers (56)(73) are respectively engaged by pins (86*a*)(87*a*) each provided at one end of a bight selecting lever (86) and of a feed selecting lever (87) which are each turnable on pivot shafts (84)(85). Pawls (86*b*)(87*b*). each formed at the other end of the selecting levers (86)(87), are engaged by a spring (91) with a bight selecting cam (89) and a feed selecting cam (90) respectively which are fixed on a vertical shaft (88) rotatably supported on the machine. The selecting cams (89)(90) are connected to a reversible motor (M1) via a gear (93) which is secured to the shaft (88) and engaging a pinion (92) fixed to a rotary shaft of the reversible motor (M1). A position detector (VR1) is mounted on the shaft (88) for sensing the position of the reversible motor (M1).

Figure 9:
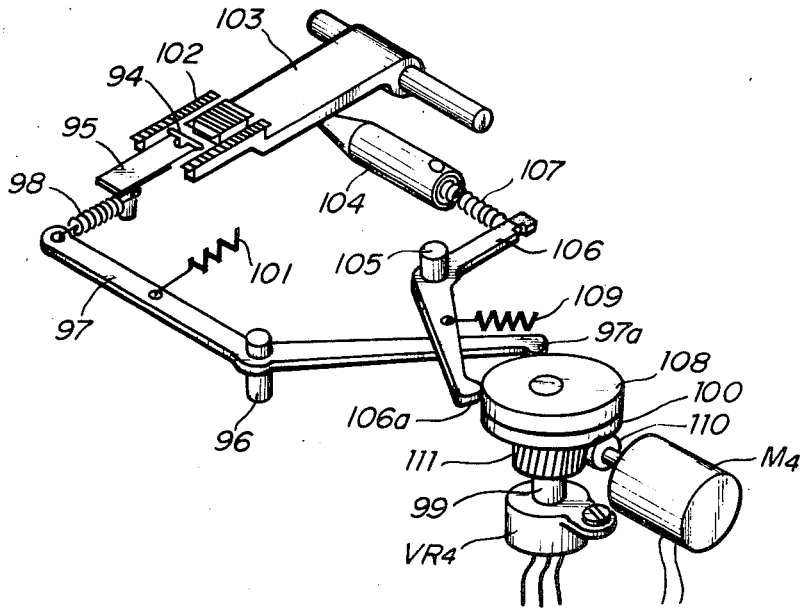
FIG. 9 is a perspective view of a mechanism of the invention for exchanging the needle hole of the needle plate and for adjusting the height of the feed dog.

FIG. 9 shows an embodiment for changing the needle hole of a needle plate and for adjusting the height of a feed dog. Reference will now be made to this embodiment. A slide element (95) is formed with a small hole for a straight stitching and is slidingly movable on the needle plate relative to the slot-type needle hole of the needle plate. The element (95) is at one end connected to one end of a lever (97) pivoted on a shaft (96) via an elastic member (98), and a pawl (97*a*) formed at the other end of the lever (97) is engaged by a spring (101) to a cam (100) which is secured to a shaft (99) rotatably supported on the machine frame. A plunger (104) engaging the under side of a feed plate (103) formed with a feed dog (102) is connected via an elastic member (107) to one end of a lever (106) pivoted on a shaft (105). A pawl (106*a*) formed at the other end of the lever (106) is engaged by a spring (109) to a cam (108) fixed to the shaft (99). The cams (100)(108) are connected to reversible motor (M4) via a gear secured to the shaft (99) and engaging a pinion (110) of the reversible motor (M4). A position detector (VR4) is provided a for sensing the position of the reversible motor (M4).

Figure 10B:
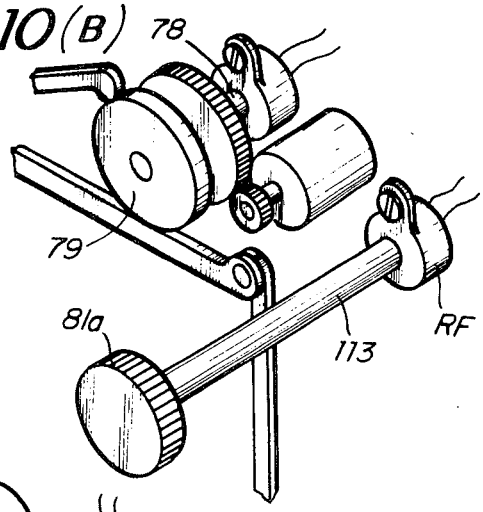
FIGS. 10A and 10B depicts the modified parts of a modified version of the mechanism of FIG. 8.
Figure 10A:
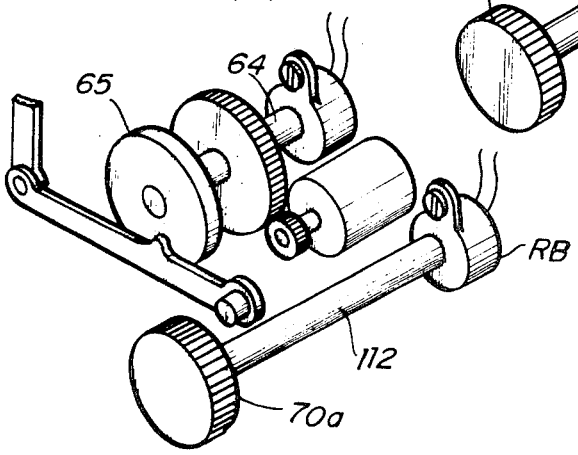

FIG. 10 shows another embodiments according to the invention. In FIG. 10(A), the bight adjusting shaft (64) shown in FIG. 8 is terminated at the bight adjusting cam (65), and a manual bight adjusting shaft (112) is rotatably supported on the machine frame in parallel to the shaft (64). A manual bight adjusting dial (70*a*) is secured to one end of the shaft (112) and a manual bight adjuster (RB) is mounted on the other end of the shaft (112). In FIG. 10(B), the feed adjusting shaft (78) shown in FIG. 8 is terminated at the feed adjusting cam (79), and a manual feed adjusting shaft (113) is rotatably supported on the machine frame. A manual feed adjusting dial (81*a*) is secured to one end of the shaft (113) and a manual feed adjuster (RF) is mounted on the other end of the shaft (113).

The operation of the embodiment of FIG. 8 will be discussed. If any one of the pattern selecting switches provided on the front part of the sewing machine is operated, the following operation is performed in steps which have been in advance electrically programmed. A solenoid for the clutch mechanism (not shown) is actuated to rotate the machine motor at a low speed so as to stop the needle bar at the upper dead point. Subsequently, each of the reversible motors (M2)(M3) is rotated to disengage the bight cam followers (56) and the feed cam follower (73) from the pack of cams (1), and then the motors are stopped.

At the same time, the reversible motor (M4) in FIG. 9 is rotated to operate the slide element (95) and the plunger (104) so as to determine the needle hole and the height of the feed dog (102) in accordance with the pattern selected, and then the motor (M4) is stopped. Subsequently the reversible motor (M1) is rotated to displace the followers (56)(73) along the pack of cams (1) to the selected ones of these cams (1), and then the motor (M1) is stopped. Then the reversible motors (M2)(M3) are again rotated, to engage the cam followers (56)(73) to the respective selected cams via the transmission rod (62) and the swing shaft (60), and via the feed control arm (75) and the swing shaft (60) respectively, and then the motors (M2), (M3) are stopped. Thus, the manual bight adjusting dial (70) and the manual feed adjusting dial (81) can now be used to provide the manual adjustment if desired, the automatic setting for pattern selection having been finished. In case the buttonhole stitch is selected by the corresponding pattern selecting switch, the automatic setting is of course possible therefor, but if desired manual adjustment is carried out by the dials (70)(81) and then the manually selected value is memorized electrically. For example, if the pattern selecting switch for the buttonhole stitch is operated to form the first left side line tack stitches, the following right side line tack stitches are formed with the same bight and with the same feeding pitch. Thereafter, the stitching in accordance with the manual setting will be repeated for each successive switch operation. It is possible to again return to the automatic setting by once pushing another pattern selecting switch.

In the embodiment of FIG. 10, when any one of the pattern selecting switches (S) is operated, the needle bar stops at the upper dead point, and the followers (56)(73) are disengaged from the pack of cams (1) by the reversible motors (M2)(M3), and at the same time the slide element (95) and the plunger (104) in FIG. 9 adjust the needle hole and the height of the feed dog (102) in accordance with the selected pattern by operation of the reversible motor (M4). Subsequently the reversible motor (M1) is rotated to displace the followers (56)(73) along the cams (1) to the selected ones. Subsequently, the bight adjusting rod (62) and the feed adjusting rod (77) are moved by the reversible motors (M2)(M3) to the position associated with the selected pattern, and the clutch mechanism is released and the automatic setting for pattern selection is finished. Then these motors (M2)(M3), however, remain active in a steady-state condition, differently from the embodiment in FIG. 8. Subsequently when the manual bight adjusting dial (70*a*) and the manual feed adjusting dial (81*a*) are adjusted to desired positions, and then one or both of a manual bight switch and a manual feed switch on the machine frame is operated, the resultant data are issued to rotate one or both of the reversible motors (M2)(M3) and the bight adjusting rod (62) and the feed adjusting rod (77) are operated respectively to the adjusted positions. Thus, the manual setting is finished. When the pattern selecting switch (S) is again operated, the manual setting is switched to the above mentioned automatic setting. If another pattern selecting switch is operated, the automatic setting of a different pattern is obtained.

Figure 11:
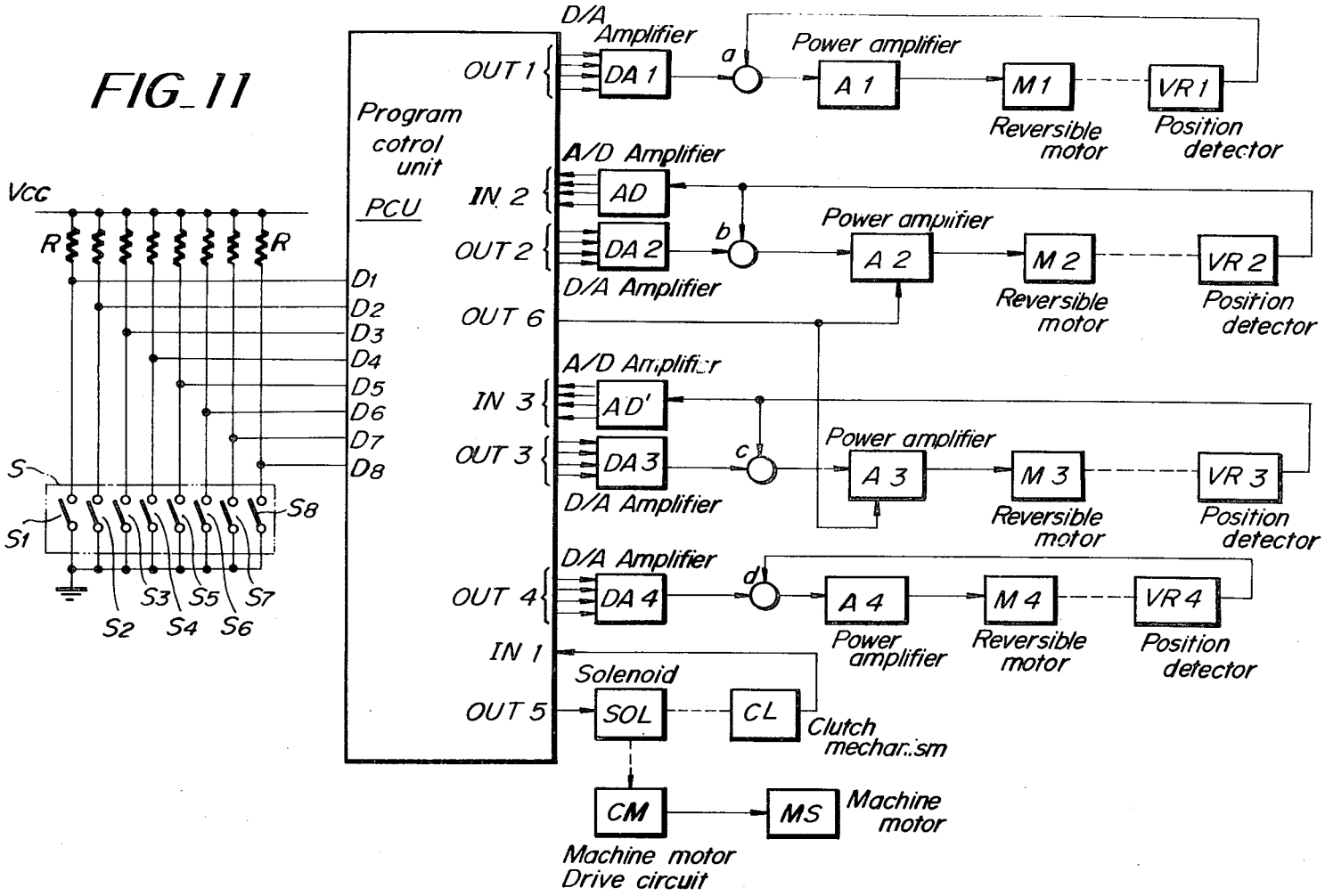
FIG. 11 is an electric block diagram for the embodiment of FIG. 8, and, FIG. 12 is an electric block diagram for the embodiments of FIG. 10.

An explanation will be made of the electric circuit shown in FIG. 11 which is used in combination with the embodiment of this invention shown in FIG. 8 and FIG. 9. Pattern selecting switches (S1)-(S8) of a pattern selector (S) are arranged on the front part of the sewing machine, and are each at one end grounded and at the other end connected to the input terminals (D1)-(D8) of a program control unit (PCU). (Vcc) is a DC power source for the control circuit. (R)-(R) are normal biasing resistors which make the values of the input terminals (D1)-(D8) of the program control unit (PCU) 1 or 0 in response to opening or closing of the switches (S1)-(S8). The program control unit (PCU) is responsive to the signals received at the input terminals (D1)-(D8) and the input terminals (IN1) (IN2)(IN3), and issues at the output terminals (OUT1)-(OUT6) the signals for controlling the reversible motors (M1)-(M4), power amplifiers (A2)(A3) and the magnetic solenoid (SOL) for the clutch mechinism stopping the sewing machine at a predetermined position. The respective output terminals (OUT1)-(OUT4) are connected to D/A converters (DA1)-(DA4), summing junctions (a)-(d), power amplifiers (A1)-(A4), and to the reversible motors (M1)-(M4). The outputs of position detectors (VR1)-(VR4), which detect the positions of the cams (65)(79)(89)(90)(100)(108) driven by these motors, are respectively connected to the junctions (a)-(d) where the outputs of the position detectors and the data from the converters (AD1)-(AD4) are respectively compared. If there are differences between the compared data, the reversible motors continue to rotate. If the compared data are each equal, the reversible motors (M1)-(M4) are stopped in a steady-state condition. Namely when the output data of the D/A converters match the data at the positions of said cams, the outputs of the respective power amplifiers (A1)-(A4) become 0, and the reversible motors (M1)-(M4) are stopped. The outputs of the position detectors (VR2)(VR3) are each connected to input terminals (IN2)(IN3) respectively of the program control unit (PCU) via A/D converters (AD)(AD'), so that the data of the respective postition detectors may be memorized by the unit (PCU). When one of the pattern selecting switches (S), for example a switch for a buttonhole is selected, the position detectors (VR2)(VR3) memorize the data when they are adjusted the manual dials (16)(27) for the needle bight and the cloth feed, and enable the sewing machine to repeatedly form a pattern exhibiting the selected bight and feed pitch. The output terminal (OUT6) is for making 0 the outputs of the power amplifiers (A2)(A3), when the automatic setting of a pattern selection is finished, to render the reversible motors (M2)(M3) inactive, and the motors will not be affected if the detectors (VR2)(VR3) are manually adjusted. A magnetic solenoid (SOL) is operated by a signal from the output terminal (OUT5) of the program control unit (PCU) to connect and disconnect the main shaft of the sewing machine to and from the clutch mechanism (CL) for stopping the needle bar at a predetermined position (the upper dead point in this case). An actuating part of the solenoid is equipped with a switch for operating a driving circuit (CM) of the machine motor. Therefore when the solenoid is energized the machine motor (Ms) can be rotated at a low speed, irrespectively of a controller (not shown) of the sewing machine. When the needle bar has been brought to the upper dead point, the needle bar is stopped there by the clutch mechanism (CL), and at the same time a signal detecting the needle bar at the upper dead point is given to the input terminal (IN1), and the machine motor (MS) continues to idlly rotate until said solenoid is deenergized.

Explanation will be made to the embodiment in FIG. 10 (A) and 10 (B) in combination with the mechanism in FIG. 9 and controlled by the electric circuit in FIG. 12. In the electric circuit, (SB) is a manual bight control switch. (SF) is a manual feed control switch. They are each at one end grounded and are each at the other end connected to input terminals (IN6) of a program control unit (PCU). After any one of the pattern selecting switches (S1)-(S8) is operated, the manual operation of one or both of the switches (SB) (SF) will provide the following manual adjusting operation. (AS2)(AS3) are analog switches and usually render the automatic side effective as shown. These analog switches cause one or both of the manual bight adjustor (RB) and the manual feed adjustor (RF) to be effective through the signals from the output terminals (OUT6) (OUT6') of the program control unit (PCU) when one or both of the switches (SB)(SF) is/are operated.

The operation of the electric circuit is as follows; In FIG. 11. when any one of the pattern selecting switches (S1)-(S8) is operated, the magnetic solenoid (SOL) is energized by a signal from the output terminal (OUT5) of the program control unit (PCU) to make effective the clutch mechanism (CL) for stopping the needle bar at the determined position, and to operate the drive circuit (CM) of the machine motor (MS) to rotate the machine motor at a low speed. The sewing machine is stopped by the clutch mechanism (CL) when the needle bar has been raised to the upper dead point, and the machine motor continues to idly rotate. When a signal confirming the needle bar at the upper dead point is given to the input terminal (IN1), the reversible motors (M2)(M3) are rotated by signals from the output terminals (OUT2-)(OUT3) until the pattern cam followers (56)(73) are disengaged from the pack of cams (1), whereupon motors (M2), (M3) have now reached steady-state and therefore stop. Simultaneously the reversible motor (M4) is rotated by the signals issued from the output terminals (OUT4) by the selected switch, and moves the slide element (95) and the feed dog (104) to the positions associated with to the selected pattern, and then the motor is stopped in steady-state condition. Subsequently the reversible motor (M1) is rotated by the signals from the output terminals (OUT1), and displaces the cam followers (56)(73) relative to the pack of cams (1) to the selected ones thereof, and then the motor is stopped. Then the reversible motors (M2)(M3) are re-rotated by the signals from the output terminals (OUT2-)(OUT3) to engage the cam followers (56)(73) to the selected cams, and also to adjust the bight adjusting rod (62) and the feed adjusting rod (77) to the relative positions in accordance to the selected pattern. Simultaneously the solenoid (SOL) is deenergized to stop the machine motor (MS), the outputs from the power amplifiers (A2)(A3) are made 0 by the signal from the output terminal (OUT6), and the reversible motors (M2)(M3) are made inactive. Thus the automatic pattern selection is finished. If then manual adjustment is further desired, the bight and the feed can be adjusted by operating the respective manual control dials (70)(81). In this case, the setting values of the position detectors (VR2)(VR3) are varied, but the reversible motors (M2) (M3) will not be re-rotated.

When the buttonhole stitch is selected by one of the switches (S1)(S8), the automatic setting is provided as explained above, and subsequently the manual adjustments can be performed using the manual adjusting dials (70)(81). Namely in the first place, a switch for the left side line tack stitches of a buttonhole is operated, and then the manual adjusting dials (70)(81) are operated to determine the bight and feed pitches in accordance to the selected buttonhole. After the left side line tack stitches have been terminated, a switch for the right side line tack stitches is operated. Then the program control unit (PCU) is operated to automatically select a cam for such stitches, and after that, the reversible motors (M2)(M3) are re-rotated to automatically set the bight and the feed pitches which are the same as those of the just sewn left side line tack stitches based on the data memorized from the previously operated manual adjusting dials (70)(81). The subsequent left line tack stitches and the right line tack stitches can be provided by repeated operations of the two switches with the same needle bight and the same feed pitches. For returning to the automatic setting, a pattern selecting switch other than the buttonhole switches is operated.

Figure 12:
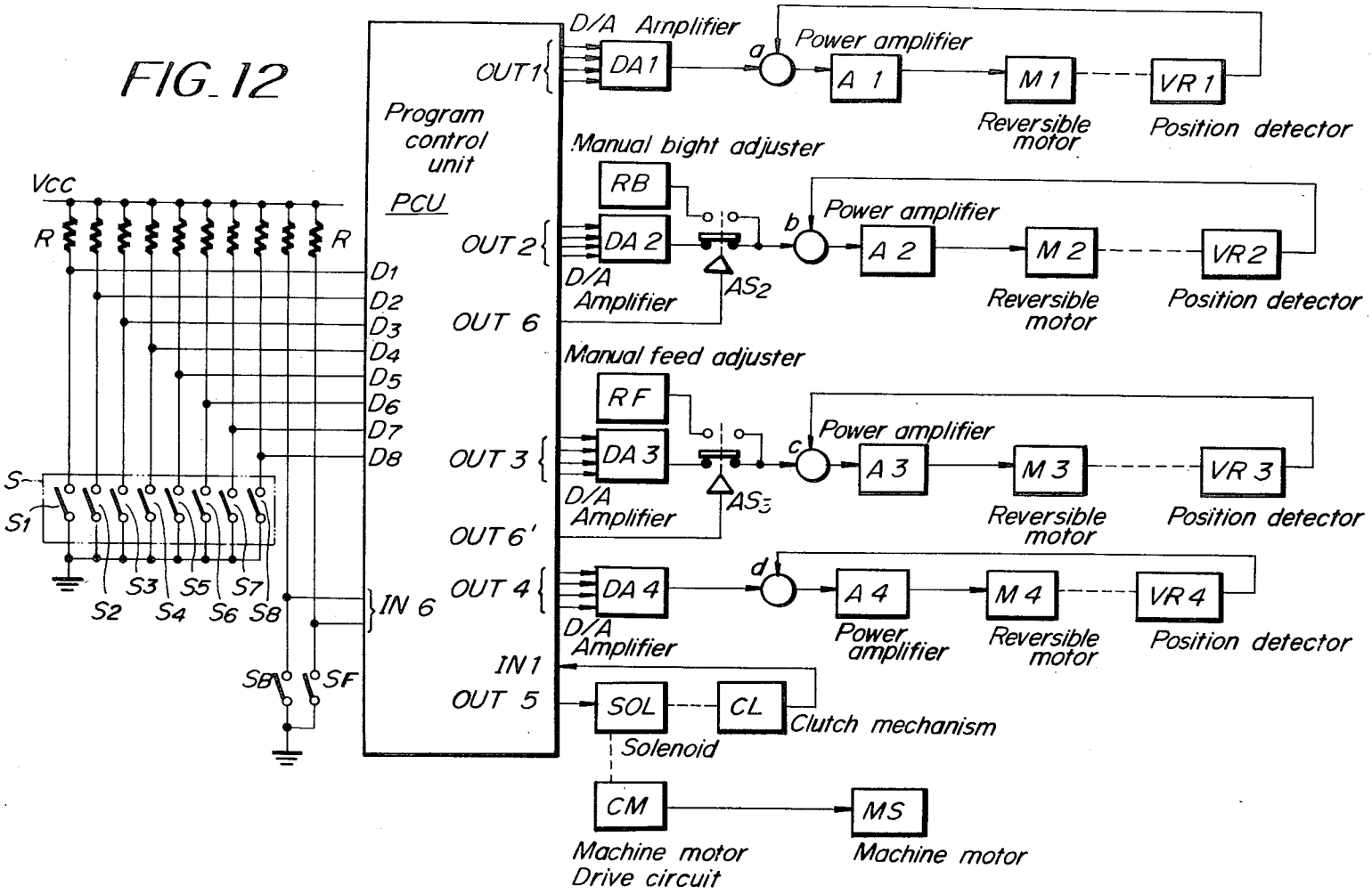

In FIG. 12 showing another embodiment, when any one of the pattern selecting switches (S1)-(S8) is operated, the needle bar is stopped at the upper dead point as in the preceding embodiment and the cam followers (56)(73) are disengaged from the cams (1) by the reversible motors (M2)(M3), and then the respective motors are stopped. At the same time the reversible motor (M4) moves the slide element (95) and the feed dog (104) to the positions associated with the selected pattern, and then the motor is stopped. Then the reversible motor (M1) displaces the cam followers to the selected positions relative to the cams (1). Subsequently, the reversible motors (M2)(M3) engage the cam followers to the selected cams and also adjust the bight adjusting rod (62) and the feed adjusting rod (77) to the positions associated with the selected pattern and then the motors are stopped. Then the solenoid (SOL) is deenergized and the machine motor (MS) is stopped to finish the automatic selecting of pattern cams. When manual adjustment is desired, either or both of the manual bight switch (SB) and the manual feed switch (SF) is/are operated to connect in the manual bight adjustor (RB) and/or the manual feed adjustor (RF). If one or both of the manual adjusting dials (70*a*)(81*a*) is/are operated before or after this change-over, the generated data are memorized in one or both of the adjustors (RB)(RF), and one or both of the reversible motors (M2)(M3) is/are rotated to operate the bight adjusting rod (62) and the feed adjusting rod (77) to the positions determined by the memorized data, and thus the manual setting is finished. In this embodiment, the buttonhole can be obtained in the same manner as in the preceding embodiment shown in FIGS. 8, 9 and 11.

I claim:

1. In a sewing machine of the type comprising a pack of pattern cams rotatable in synchronism with sewing-machine operation and a cam follower coupled to the machine's stitch-forming instrumentalities and mounted to track selected ones of the pattern cams, an improved pattern-selection system comprising, in combination, user-operated pattern-selecting means operated by the user for selecting a stitching pattern and generating when operated pattern-selection signals;

a program-control unit including a static memory having inputs receiving the pattern-selection signals and having outputs, and producing at its outputs, in response to the pattern-selection signals, cam-selection and follower-control signals determined by what pattern the user has selected;

electromagnetic follower-control means responding to the follower-control signals by causing the cam follower to move out of engagement with the pack of pattern cams preliminary to axial shifting of the follower from one to another of the pattern cams and operative for thereafter returning the cam follower into engagement with the pack of pattern cams;

and cam-selecting means responding to the cam-selection signals by causing the cam follower to shift in the direction axially of the pack of pattern cams from one pattern cam to the pattern cam corresponding to the pattern the user has selected, the cam-selecting means including a reversible electric motor having an electrical input and a mechanical output, motor-control circuit means having an input connected to receive the pattern-selection signals and having an output connected to the electrical input of the reversible electric motor and controlling the energization and direction of operation of the latter, and coupling means coupling the mechanical output of the reversible electric motor to the cam follower for converting the motion generated by the reversible electric motor into axial shifting movement of the cam follower.

2. The pattern-selection system defined in claim 1, the motor-control circuit means including a feedback transducer coupled to and driven by the mechanical output of the reversible electric motor and generating feedback signals indicative of the position of the cam follower measured in the direction axially of the pack of pattern cams, and servo circuit means receiving both the cam-selection signals and the feedback signals and having an output connected to the electrical input of the reversible electric motor and controlling the energization and direction of operation of the latter in dependence upon the discrepancy between the feedback and cam-selection signals.

3. The pattern-selection system defined in claim 1, wherein the electromagnetic follower-control means comprises a second reversible electric motor having an electrical input and a mechanical output, motor-control circuit means having an input connected to receive the follower-control signals and having an output connected to the electrical input of the second reversible electric motor and controlling the energization and direction of operation of the latter, and coupling means coupling the mechanical output of the second reversible electric motor to the cam follower for converting the motion generated by the second reversible electric motor into movement of the cam follower into and out of engagement with the pack of pattern cams.

4. The pattern-selection system defined in claim 3, the motor-control circuit means of the follower-control means including a feedback transducer coupled to and driven by the mechanical output of the second reversible electric motor and generating second feedback signals indicative of the position of the cam follower considered in the direction in which the follower moves into and out of engagement with the pack of pattern cams, and servo circuit means receiving the follower-control signals and the second feedback signals and having an output connected to the electrical input of the second reversible electric motor and controlling the energization and direction of operation of the latter in dependence upon the discrepancy between the second feedback and follower-control signals.

5. The pattern-selection system defined in claim 1, the electromagnetic follower-control means comprising a plunger-type electromagnet coupled to the cam follower for moving the cam follower into and out of engagement with the stack of pattern cams.

6. The pattern-selection system defined in claim 2, the feedback transducer being a rotary potentiometer coupled to the mechanical output of the reversible electric motor.

7. The pattern-selection system defined in claim 2, the feedback transducer being an elongated variable resistor comprised of a stationary part and a wiper, the wiper being coupled to the cam follower and shifting along the length of the stationary part as the cam follower shifts in the direction axially of the pack of pattern cams.

8. The pattern-selection system defined in claim 4, the feedback transducer of the follower-control means and likewise the feedback transducer of the cam-selecting means each being a rotary potentiometer coupled to the mechanical output of the respective one of the two recited reversible electric motors.

9. The pattern-selection system defined in claim 1, the follower-control means furthermore including a locking mechanism operative when the cam follower is in engagement with the pack of pattern cams for precluding shifting of the cam follower in the direction axially of the pack of pattern cams, whereby to preclude destruction of the follower and/or of the coupling means if the cam-selecting means due to malfunction improperly attempts to shift the cam follower while the latter is in engagement with the pack of pattern cams.

10. The pattern-selection system defined in claim 3, the cam follower and pack of pattern cams being part of an adjustable-amplitude motion generator, the tracking of a selected pattern cam by the cam follower determining the motion generated but the motion generator being provided with motion-multiplying means adjustable in setting for increasing and decreasing the motion generated by the cam follower and cooperating pattern cam, the coupling means of the follower-control means coupling the mechanical output of the second reversible electric motor to both the cam follower and the motion-multiplying means, and the program-control unit producing follower-control signals which additionally determine what the motion-multiplying factor will be, whereby in addition to causing the cam follower to move into and out of engagement with the pack of pattern cams the second reversible electric motor, under the control of the program-control unit, also adjusts the motion-multiplying factor as a function of the selected pattern.

11. The pattern-selection system defined in claim 15, the coupling means of the follower-control means including a mechanical component provided with a user-operated selecting element for user-performed adjustment of the motion-multiplying factor, the reversible electric motor moving the cam follower into and out of engagement with the pack of pattern cams through the intermediary of the mechanical component, whereby when the reversible electric motor brings the cam follower into engagement with a pattern cam it simultaneously performs an automatic selection of the motion-multiplying force which, however, can be followed by manual modification of the motion-multiplying force.

12. The pattern-selection system defined in claim 11, furthermore including a feedback transducer coupled to and driven by the reversible electric drive motor and generating a feedback signal indicating the position of the mechanical output of the motor, the program-control unit having memory inputs receiving the feedback signal for memorizing the position of the mechanical output of the motor, whereby if the user has manually adjusted the motion-multiplying factor the factor selected by the user can be memorized for later repetition.

* * * * *